US007151519B2

(12) United States Patent
Lee

(10) Patent No.: US 7,151,519 B2
(45) Date of Patent: Dec. 19, 2006

(54) LIQUID CRYSTAL DISPLAY

(75) Inventor: Sung-Ho Lee, Kyungki-do (KR)

(73) Assignee: Samsung Electronics Co., Ltd. (KR)

( * ) Notice: Subject to any disclaimer, the term of this patent is extended or adjusted under 35 U.S.C. 154(b) by 527 days.

(21) Appl. No.: 10/751,171

(22) Filed: Dec. 30, 2003

(65) Prior Publication Data

US 2004/0196227 A1 Oct. 7, 2004

(30) Foreign Application Priority Data

Dec. 31, 2002 (KR) ..... 10-2002-0088086

(51) Int. Cl.
*G09G 3/36* (2006.01)

(52) U.S. Cl. ..... 345/98; 345/100

(58) Field of Classification Search ..... 345/98–100, 345/204; 327/54; 377/64
See application file for complete search history.

(56) References Cited

U.S. PATENT DOCUMENTS 4,844,590 A * 7/1989 Okada et al. ..... 345/97
5,856,816 A * 1/1999 Youn ..... 345/98
5,856,818 A * 1/1999 Oh et al. ..... 345/99
6,232,946 B1 * 5/2001 Brownlow et al. ..... 345/98
6,909,414 B1 * 6/2005 Tsuchi et al. ..... 345/89
2004/0239668 A1 * 12/2004 Morosawa et al. ..... 345/212
2005/0168252 A1 * 8/2005 Kubota et al. ..... 327/154

* cited by examiner

*Primary Examiner*—Ricardo Osorio
(74) *Attorney, Agent, or Firm*—MacPherson Kwok Chen & Heid LLP

(57) ABSTRACT

A liquid crystal display includes: a plurality of pixels: a data driver including a memory and a register and supplying data signals to the pixels; and a signal controller supplying a control signal for controlling the data driver to the data driver, wherein the register includes a bit storing a data for determining a frequency of the control signal. The data driver operates in synchronization with the frequency of the control signal. The control signal includes a data enable signal.

2 Claims, 2 Drawing Sheets

LIQUID CRYSTAL DISPLAY

CROSS-REFERENCE TO RELATED APPLICATION

This application claims priority, under 35 U.S.C. Section 119, from Korean Patent Application Serial Number 10-2002-0088086 filed on Dec. 31, 2002, which is incorporated herein by reference in its entirety.

BACKGROUND OF THE INVENTION (a) Field of the Invention

The present invention relates to a liquid crystal display, and in particular, to an RGB interface type liquid crystal display.

(b) Description of the Related Art

A typical liquid crystal display (LCD) includes an upper panel provided with a common electrode and a plurality of color filters and a lower panel provided with a plurality of thin film transistors (TFTs) and a plurality of pixel electrodes. Alignment layers are coated on inner surfaces of the upper and the lower panels, and a liquid crystal layer is filled in a gap between the alignment layers. The pixel electrodes and the common electrode are supplied with voltages, and the voltage difference between the two electrodes generates an electric field. When the strength and/or the direction of the electric field is changed, orientations of liquid crystal molecules in the liquid crystal layer is changed according thereto and the transmittance of light passing through the liquid crystal layer. Accordingly, desired images are obtained by controlling the voltage difference between the pixel electrodes and the common electrode.

In the meantime, small and medium LCDs are driven in two types, roughly. One is an RGB interface type and the other is a CPU interface type. The former separately inputs image data and control signals for chip driving, while the latter sequentially inputs the image data and the chip driving control signals.

A small LCD used for a mobile phone, etc., roughly includes a phone and a panel assembly.

The panel assembly corresponds to a display unit like a typical LCD, and the phone supplies various control signals for controlling the panel assembly.

An LCD employing RGB interface such as a mobile phone requires extremely low power consumption. Most of the power consumption depends on the speed or the frequency of a data enable signal.

The data enable signal indicates the existence of data by using its signal levels. For example, a high section of the data enable signal indicates the existence of data and a low section indicates the absence of data.

Generally, a small device such as a mobile phone transmits image data with a frequency of about 60 Hz. In the meantime, a data driver operates in synchronization with the frequency of the data enable signal. In detail, a memory incorporated in the data driver determines the writing of the data based on the levels of the data enable signal, and, for example, the data are written into the memory during the high section of the data enable signal. After the data are written in the memory, they are transmitted to the panel assembly to form images.

Meanwhile, since most of the image data for the mobile phone, etc., represent still images, the data stored in the memory can be repeatedly used. Accordingly, repeated writing of the same data is meaningless and causes the continuous operation of the data driver, thereby causing power consumption.

SUMMARY OF THE INVENTION

Accordingly, a motivation of the present invention is to provide a liquid crystal display for selecting operating frequencies based on a predetermined reference signal, thereby minimizing power consumption. Although an embodiment of the present invention selects a data enable signal as the reference signal, the reference signal may not be limited to the data enable signal.

A flat panel display according to an embodiment of the present invention includes: a plurality of pixels: a data driver including a memory and a register and supplying data signals to the pixels; and a signal controller supplying a control signal for controlling the data driver to the data driver, wherein the register includes a bit storing a data for determining a frequency of the control signal.

Preferably, the data driver operates in synchronization with the frequency of the control signal.

The control signal preferably includes a data enable signal.

BRIEF DESCRIPTION OF THE DRAWINGS

The present invention will become more apparent by describing embodiments thereof in detail with reference to the accompanying drawings in which.

DETAILED DESCRITPION OF EMBODIMENTS

Figure 1:
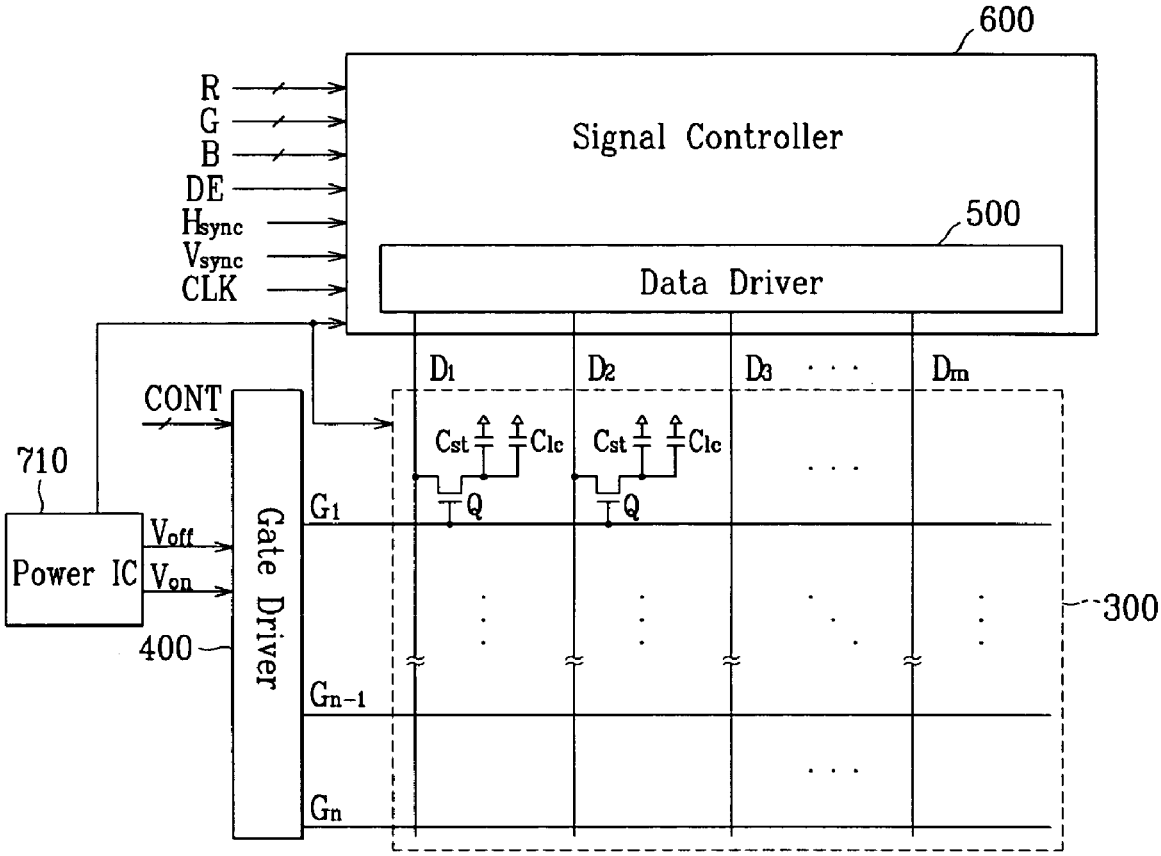
FIG. 1 is a block diagram of an LCD according to an embodiment of the present invention.

The present invention now will be described more fully hereinafter with reference to the accompanying drawings, in which preferred embodiments of the invention are shown. The present invention may, however, be embodied in many different forms and should not be construed as limited to the embodiments set forth herein.

In the drawings, the thickness of layers, films and regions are exaggerated for clarity. Like numerals refer to like elements throughout. It will be understood that when an element such as a layer, film, region or substrate is referred to as being "on" another element, it can be directly on the other element or intervening elements may also be present. In contrast, when an element is referred to as being "directly on" another element, there are no intervening elements present.

Now, liquid crystal displays according to embodiments of the present invention will be described with reference to the accompanying drawings.

Figure 2:
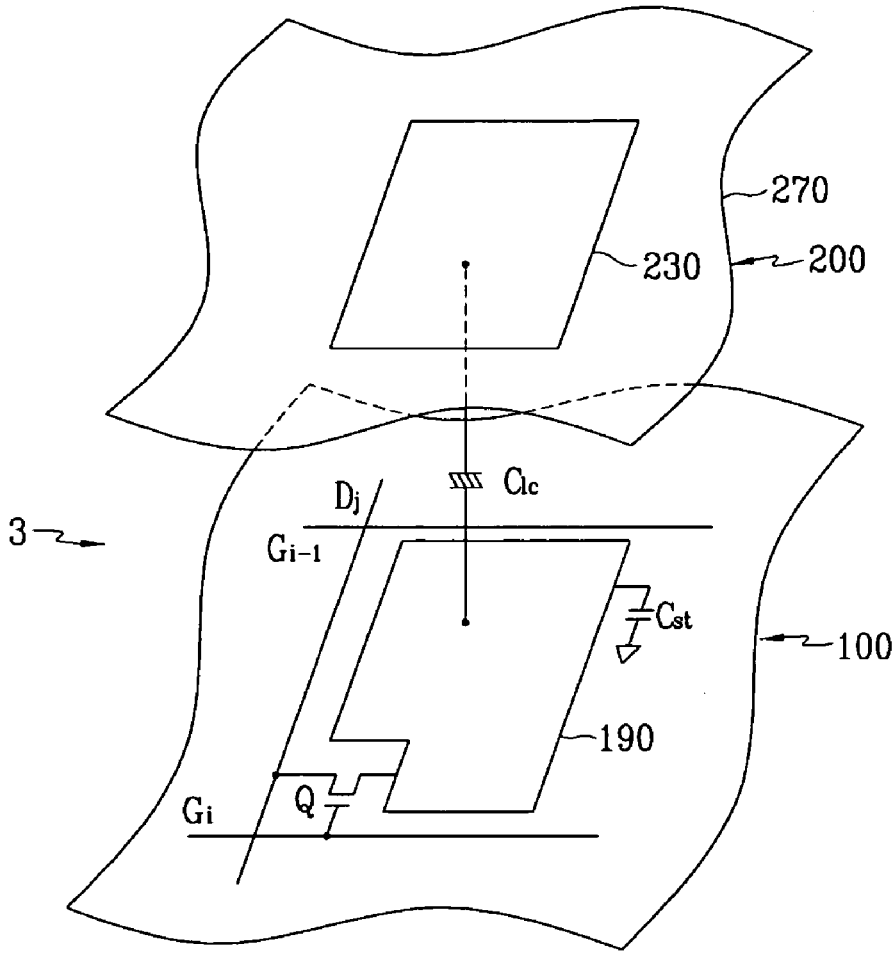
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment of the present invention includes a liquid crystal panel assembly 300, a gate driver 400 and a signal controller 600 connected to the panel assembly 300, and a power IC (integrate circuit) 700 supplying voltages thereto.

In circuital view, the liquid crystal panel assembly 300 includes a plurality of display signal lines $G_1$–$G_n$ and $D_1$–$D_m$, and a plurality of pixels connected thereto and arranged in a matrix.

The display signal lines $G_1$–$G_n$ and $D_1$–$D_m$ includes a plurality of gate lines $G_1$–$G_n$ transmitting gate signals (also called "scanning signals") and a plurality of data lines $D_1$–$D_m$ transmitting data signals. The gate lines $G_1$–$G_n$ extend substantially in a row direction and are substantially parallel to each other. The data lines $D_1$–$D_m$ extend substantially in a column direction and are substantially parallel to each other.

Each pixel includes a switching element Q connected to the display signal lines $G_1$–$G_n$ and $D_1$–$D_m$, and a liquid crystal capacitor $C_{lc}$ and a storage capacitor $C_{st}$ connected thereto. The storage capacitor $C_{st}$ may be omitted if it is not required.

The switching element Q is provided on a lower panel 100 and has three terminals: a control terminal connected to a gate line $G_1$–$G_n$; an input terminal connected to a data line $D_1$–$D_m$; and an output terminal connected to the liquid crystal capacitor $C_{lc}$ and the storage capacitor $C_{st}$.

The liquid crystal capacitor $C_{lc}$ includes two terminals formed by a pixel electrode 190 of the lower panel 100 and a common electrode 270 of an upper panel 200, and it also includes a liquid crystal layer interposed between the two electrodes 190 and 270 serving as a dielectric. The pixel electrode 190 is connected to the switching element Q, and the common electrode 270 is supplied with a common voltage $V_{com}$. Unlike FIG. 2, the common electrode 270 may be provided on the lower panel 100 and in this case, the two electrodes 190 and 270 may be linear or may have bar shapes.

The storage capacitor $C_{st}$ is formed by overlap of the pixel electrode 190 and a separate wire (not shown) provided on the lower panel 100, which is supplied with a predetermined voltage such as the common electrode $V_{com}$. Otherwise, the storage capacitor $C_{st}$ is formed by overlap of the pixel electrode 190 and a previous gate line with interposing an insulator.

For realizing color display, each pixel represents a color by providing red, green, or blue color filter 230 in an area corresponding to the pixel electrode 190. Although FIG. 2 shows a color filter 230 is provided on a corresponding area of the upper panel 200, the color filters 230 may be provided on or under the pixel electrodes 190 on the lower panel 100.

Liquid crystal molecules changes their orientations depending on the variation of the electric field generated by the pixel electrode 190 and the common electrode 270 and thus polarization of light passing through the liquid crystal layer 3 is altered. The alteration of the light polarization is converted into the alteration of the light transmittance by a (pair of) polarizer attached to the panels 100 and 200.

The power IC 700 generates a gate-on voltage $V_{on}$ and a gate-off voltage $V_{off}$ for turning on and off the switching elements Q on the panel assembly 300, and the common electrode $V_{com}$ applied to the liquid crystal capacitor $C_{lc}$ the panel assembly 300.

The gate driver 400 is connected to the gate lines $G_1$–$G_n$ of the liquid crystal panel assembly 300 and applies the gate signals formed of a combination of the power the gate-on voltage $V_{on}$ and the gate-off voltage $V_{off}$ from IC 700 to the gate lines $G_1$–$G_n$.

The signal controller 600 generates control signals for controlling the gate driver 400 and supplies the control signals to the gate driver 400. The signal controller 600 includes a data driver 500 connected to the data lines $D_1$–$D_m$ of the panel assembly 300, and the data driver 500 converts image data R, G and B from an external device into analog voltages and applies the analog voltages to the data lines $D_1$–$D_m$.

Now, the display operation of the LCD is described in detail.

The signal controller 600 receives, from a graphics controller such as a mobile phone (not shown), RGB the image signals R, G and B and input control signals for display of the image signals R, G and B. The input control signals include a vertical synchronization signal $V_{sync}$, a horizontal synchronization signal $H_{sync}$, a main clock MCLK, and a data enable signal DE. Based on the input control signals, the signal controller 600 generates gate control signals CONT to be provided for the gate driver 400 and processes the image signals R, G and B to be suitable for the liquid crystal panel assembly 300.

The gate control signals CONT include a vertical synchronization signal STV for instructing to output gate-on pulses (gate-on voltage sections of the gate signal), a gate clock CPV for controlling the timing of the gate-on pulses, and an output enable signal OE for defining widths of the gate-on pulses.

The power IC 700 generates the gate-on voltage Von and the gate-off voltage Voff to be supplied to the gate driver 400 and it also generates the common voltage Vcom to be supplied for the panel assembly 300 and the signal controller 600.

The data driver 500 of the signal controller 600 analog-converts the processed image data.

The gate driver 400 applies the gate-on voltage $V_{on}$ to the gate lines $G_1$–$G_n$ to turn on the switching elements Q connected thereto in response to the gate control signals CONT from the signal controller 600.

During the application of the gate-on voltage Von to one of the gate lines G1–Gn and during the on state of a row of the switching elements Q connected thereto, the data driver 500 applies the analog-converted image data to the data lines $D_1$–$D_m$ as the data signals. Then, the data voltages applied to the data lines $D_1$–$D_m$ are supplied to the pixels through the activated switching elements Q.

Now, the operation of the data driver 500 is described in detail.

Figure 3:
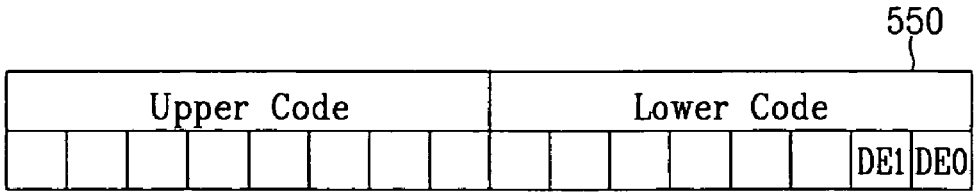
FIG. 3 is an exemplary register according to an embodiment of the present invention.

The data driver 500 includes a memory (not shown) and a register (shown in FIG. 3). The data driver 500 determines the writing of the data based on the existence of the data enable signal DE, writing the data into the memory in existence of the data enable signal DE, and transmits the data to the panel assembly 300 for image display. The register is provided for selecting operating frequencies of the data enable signal DE, which is described in detail hereinafter.

FIG. 3 is an exemplary register according to an embodiment of the present invention.

The register 550 is incorporated into the data driver 500 and includes 16 bits formed of upper 8 bits and lower 8 bits. The lower bits of register 550 according to this embodiment include bits DE0 and DE1 for controlling the data enable signal DE. Remaining bits are empty for product upgrade, which are not shown.

Control bits are pre-programmed and the data enable signal DE has operation modes depending on the established bit number. For example, if n bits are set, $2^n$ operation modes are generated.

For example, when all the image data represent motion images, the operation frequency is set to be 60 Hz. On the contrary, the operation frequency is set to be 1 Hz for still images. In addition, if the image data represent both the motion image and the still image, the programming is made to control the operation frequency depending on the ratio of the motion image and the still image.

The figure illustrates an exemplary register including two bits. The two bits enables for the data enable signal DE to operate in four modes. For example, when the values of the two bits are "00," "01," "10," and "11," the operation frequency is set to 60 Hz, 40 Hz, 20 Hz, and 1 Hz, respectively. The operation frequencies of the data enable signal DE can be obtained by a well-known frequency divider.

In this way, the panel assembly selectively receives the data enable signal DE such that the speed of the data storage into the memory is controlled to reduce the power consumption.

It is apparent that 3-bit control bits enables to operate in eight modes, and the locations of the control bits are varied.

It is obvious that the register can have various bit number although the figure shows the 16 bit register.

When operating in these modes, the frequency of the data enable signal DE is set to be only 1 Hz, if the still images are continuously required, even though the phone supplies 60 Hz frequency. The memory of the data driver also operates in a frequency of 1 Hz in association therewith. Accordingly, unnecessary power consumption is prevented.

While the present invention has been described in detail with reference to the preferred embodiments, those skilled in the art will appreciate that various modifications and substitutions can be made thereto without departing from the spirit and scope of the present invention as set forth in the appended claims.

For example, if it is used in an RGB interface type for preventing power consumption, it is also applicable to any flat panel display such as an organic electroluminescence display.

As described above, the power consumption is minimized by setting the frequency modes of the data enable signal DE, which largely contributes to the power consumption, depending on the types of images.

What is claimed is:

1. A liquid crystal display comprising:

a plurality of pixels;

a data driver including a memory and a register and supplying data signals to the pixels; and a signal controller supplying a control signal for controlling the data driver to the data driver, wherein the register includes a bit storing a data for determining a frequency of the control signal, wherein the control signal includes a data enable signal.

2. The liquid crystal display of claim 1, wherein the data driver operates in synchronization with the frequency of the control signal.

* * * * *